US007969459B2

(12) United States Patent
Kanei et al.

(10) Patent No.: US 7,969,459 B2
(45) Date of Patent: Jun. 28, 2011

(54) THERMAL PRINT HEAD

(75) Inventors: Naofumi Kanei, Kyoto (JP); Takumi Yamade, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 29 days.

(21) Appl. No.: 12/528,516

(22) PCT Filed: Feb. 21, 2008

(86) PCT No.: PCT/JP2008/052958
§ 371 (c)(1),
(2), (4) Date: Aug. 25, 2009

(87) PCT Pub. No.: WO2008/105307
PCT Pub. Date: Sep. 4, 2008

(65) Prior Publication Data

US 2010/0085412 A1 Apr. 8, 2010

(30) Foreign Application Priority Data

Feb. 26, 2007 (JP) ..... 2007-045937

(51) Int. Cl.
*B41J 2/335* (2006.01)

(52) U.S. Cl. ..... 347/203

(58) Field of Classification Search ..... 347/203
See application file for complete search history.

(56) References Cited

U.S. PATENT DOCUMENTS 6,441,840 B1 8/2002 Sato et al.
6,483,528 B1 * 11/2002 Yamade et al. ..... 347/203

FOREIGN PATENT DOCUMENTS

| | | |
|---|---|---|
| JP | 60-34449 | 3/1985 |
| JP | 62-37170 | 2/1987 |
| JP | 62-95245 | 5/1987 |
| JP | 2-172758 | 7/1990 |
| JP | 4-49057 | 2/1992 |
| JP | 4-110165 | 4/1992 |
| JP | 2000-153630 | 6/2000 |
| JP | 2002-2005 | 1/2002 |
| JP | 2004-230583 | 8/2004 |

OTHER PUBLICATIONS

Machine-generated translation of JP 2000-153630, published Jun. 2000.*

* cited by examiner

*Primary Examiner* — Huan H Tran
(74) *Attorney, Agent, or Firm* — Hamre, Schumann, Mueller & Larson, P.C.

(57) ABSTRACT

A thermal printhead (A) includes an insulating substrate (1), a heating resistor (2) provided on the substrate (1) and a protective film (4) covering the heating resistor (2). The protective film (4) is made up of a first layer (41), a second layer (42) and a third layer (43). The first layer (41) is held in contact with the heating resistor (2). The second layer (42) covers the first layer (41). The second layer (42) is harder than the first layer (41) and has a higher thermal conductivity than that of the first layer (41). The third layer (43) is the outermost layer and covers the second layer (42). The third layer (43) is harder than the second layer (42) and thinner than the second layer (42).

5 Claims, 3 Drawing Sheets

PIROR ART

THERMAL PRINT HEAD

TECHNICAL FIELD

The present invention relates to a thermal printhead used for a thermal printer.

BACKGROUND ART

A thermal printhead is a device used for printing images or letters by locally raising the temperature of a recording medium such as thermal paper (see e.g. Patent Document 1): FIG. 3 shows an example of conventional thermal printhead. The thermal printhead X shown in the figure includes a substrate 91, on which a partial glaze 92 is formed. An electrode pattern 93 is formed on the substrate 91. A heating resistor 94 connected to the electrode pattern 93 and extending in the primary scanning direction is also formed on the substrate 91. The heating resistor 94 is covered with a protective film 95. In printing, a sheet of thermal paper is moved relative to the protective film 95 in the secondary scanning direction while being pressed against the protective film.

The thermal printhead X has a drawback that thermal paper may stick to the protective film 95 during the printing operation. Generally, the surface of the thermal paper sheet is coated with resin. The resin coating melts due to the heat from the thermal printhead X and adheres to the protective film 95. When the resin coating solidifies in this state, thermal paper sticks to the protective film 95.

The likelihood of sticking increases as the printing speed increases. Conceivably, this is because the thermal paper sheet is pressed against the protective film 95 with a relatively large force and the resin coating is quickly heated and cooled in the high-speed printing.

Patent Document 1: JP-A-2002-2005

DISCLOSURE OF THE INVENTION

The present invention has been proposed under the circumstances described above. It is, therefore, an object of the present invention to provide a thermal printhead capable of achieving both of an increase in the printing speed and the prevention of sticking.

A thermal printhead provided according to the present invention includes a substrate, a heating resistor supported by the substrate, and a protective film covering the heating resistor. The protective film is made up of a first layer, a second layer and a third layer. The first layer is held in direct contact with the heating resistor. The second layer covers the first layer and is harder than the first layer. The second layer has a higher thermal conductivity than that of the first layer. The third layer covers the second layer and is harder than the second layer. The third layer is thinner than the second layer.

Preferably, the third layer has a thickness of 0.05 to 0.5 μm.

With this arrangement, the provision of the second layer increases the thermal conductance of the entire protective film. Thus, heat is efficiently transferred from the heating resistor to the thermal paper sheet, which is suitable for increasing the printing speed. By making the third layer, which is the outermost layer, hardest, shearing or deforming of the protective film during the printing is suppressed. As a result, the thermal paper sheet is easily removed from the protective film, and sticking is prevented. The shearing or deforming is prevented more reliably when the thickness of the third layer is not less than 0.05 μm. Further, the thermal conductance of the entire protective film is prevented from becoming too small when the thickness of the third layer 43 is not more than 0.5 μm. Further, with this arrangement, the substrate is prevented from excessively warping in forming the third layer in the process of manufacturing the thermal printhead.

Preferably, the third layer is made of TaN or TiN—SiAlON. These materials are suitable for making the third layer harder than the second layer and have a higher thermal conductivity than that of the second layer. Both of TaN and TiN—SiAlON have high water repellency. Thus, the third layer made of these materials properly repels melted resin coating, which is suitable for preventing sticking.

Other features and advantages of the present invention will become more apparent from the detailed description given below with reference to the accompanying drawings.

BEST MODE FOR CARRYING OUT THE INVENTION

Preferred embodiments of the present invention will be described below with reference to the accompanying drawings.

Figure 1:
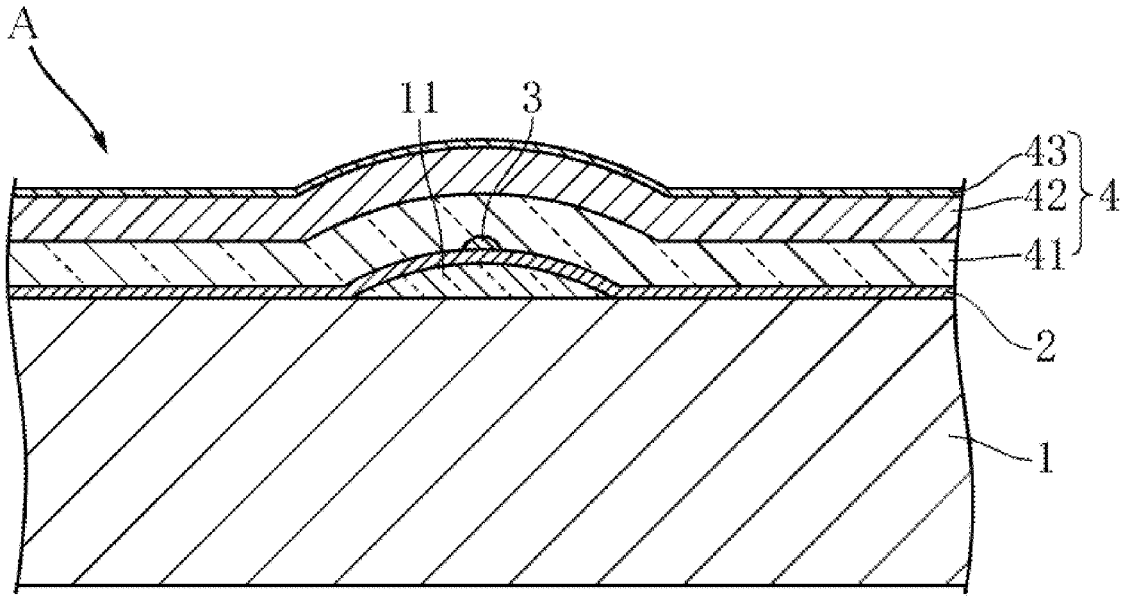
FIG. 1 is a sectional view showing a principal portion of an example of thermal printhead according to the present invention.
Figure 2:
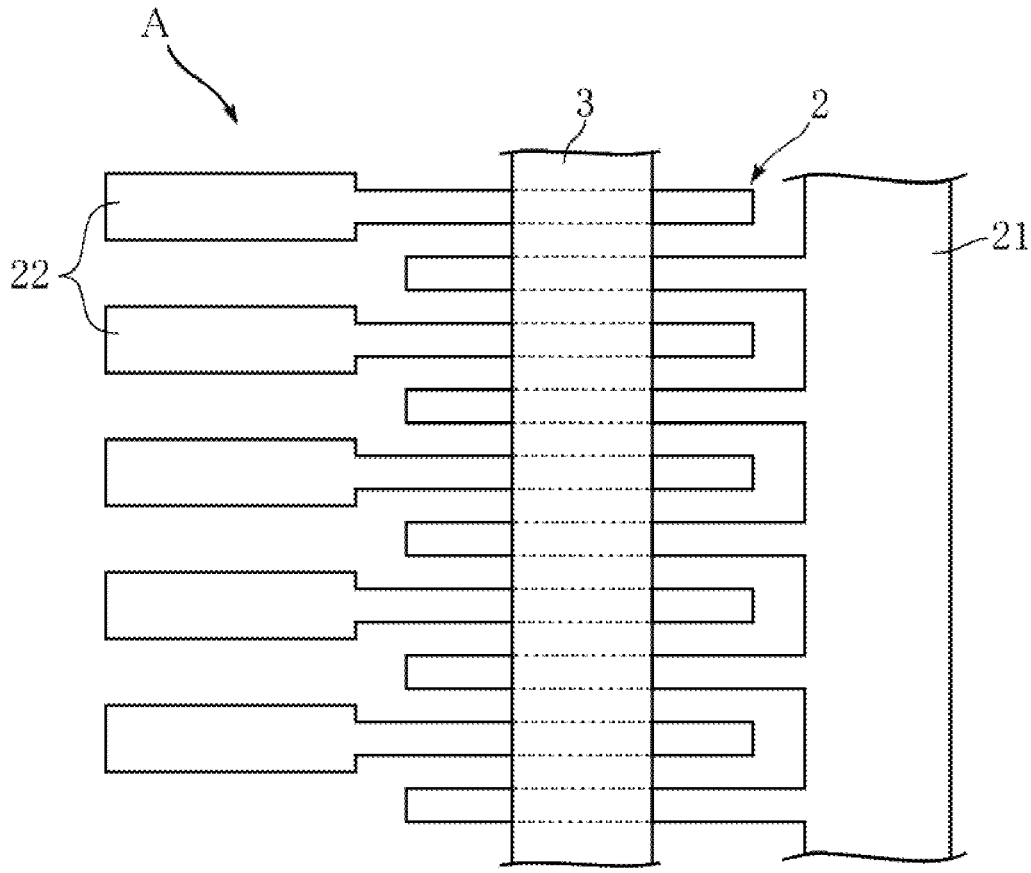
FIG. 2 is a plan view showing the principal portion of the thermal printhead of FIG. 1.
Figure 3:
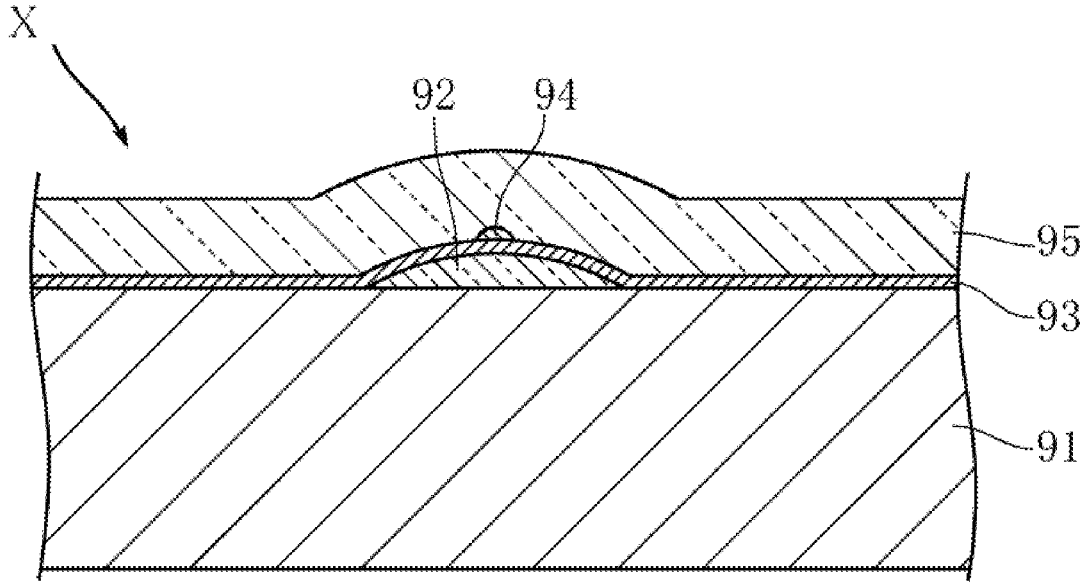
FIG. 3 is a sectional view showing a principal portion of an example of conventional thermal printhead.

FIGS. 1 and 2 show an example of thermal printhead according to the present invention. The illustrated thermal printhead A includes a substrate 1, an electrode pattern 2, a heating resistor 3 and a protective film 4. For easier understanding, only the electrode pattern 2 and the heating resistor 3 are shown in FIG. 2.

The substrate 1 is an insulating substrate made of e.g. alumina ceramic material and in the form of an elongated rectangle extending in the primary scanning direction. The substrate 1 has an upper surface formed with a partial glaze 11. The partial glaze 11 is in the form of a strip extending in the primary scanning direction. As shown in the sectional view of FIG. 1, the partial glaze 11 bulges in the thickness direction of the substrate 1 (upward in FIG. 1).

The electrode pattern 2 is for supplying electric power to the heating resistor 3. As shown in FIG. 2, the electrode pattern includes a common electrode 21 and a plurality of individual electrodes 22. The common electrode 21 includes a strip-shaped portion extending in the primary scanning direction and a plurality of branches extending like comb-teeth from the strip-shaped portion in the secondary scanning direction. The individual electrodes 22 are arranged alternately with the above-described branches in the primary scanning direction. The electrode pattern 2 may be formed by thick-film printing of resinate Au paste on the substrate 1 and the subsequent baking of the paste.

The heating resistor 3 is the source of heat generation of the thermal printhead A. The heating resistor 3 is in the form of an elongate strip extending in the primary scanning direction across the branches of the common electrode 21 and ends of the individual electrodes 22. When electric power is supplied to the heating resistor 3 through the common electrode 21 and a selected one of the individual electrodes 22, a portion of the heating resistor 3 which is in contact with that individual electrode 22 and the nearby portion generate heat. The heating resistor 3 may be formed by thick-film printing of ruthenium oxide paste and the subsequent baking.

As shown in FIG. 1, the protective film 4 covers the heating resistor 3 and is made up of a first layer 41, a second layer 42 and a third layer 43.

The first layer 41 is held' in direct contact with the heating resistor 3 and made of amorphous glass such as $SiO_2$—ZnO—MgO-based glass. The first layer 41 has a thickness of about 6 μm. The first layer 41 made of the above-described material has a hardness of about 600 Hk. The first layer 41 may be formed by applying glass paste by printing and then baking the paste.

The second layer 42 is made of a material having a higher thermal conductivity than that of amorphous glass forming the first layer 41, and SiC is an example of the material. The thickness of the second layer is about 4 μm.

The second layer 42 made of such a material has a hardness of about 1300 Hk. The second layer 42 may be formed by sputtering.

The third layer 43 is made of e.g. TaN and has a thickness of about 0.1 μm. However, this thickness is only an example and not limitative. In the present invention, the thickness of the third layer 43 is appropriately selected from the range of e.g. 0.05 to 0.5 μ. The third layer 43 made of the above-described material has a hardness of about 1400 to 1500 Hk. The third layer 43 may be formed by sputtering.

The advantages of the thermal printhead A are described below.

The second layer 42 made of SiC has a higher thermal conductivity than that of the first layer 41 made of amorphous glass. Thus, as compared with a protective film which is entirely made of amorphous glass, the protective film 4 of this arrangement has a higher thermal conductance. This is suitable for transferring heat from the heating resistor 3 to the thermal paper sheet, and hence, suitable for increasing the printing speed.

As described before, of the three layers forming the protective film 4, the third layer 43, which is the outermost layer, is the hardest. Thus, even when the force for pressing the thermal paper sheet against the protective film 4 is increased, the third layer 43 hardly shears or deforms. As a result, the thermal paper sheet can be easily removed from the protective film 4, and sticking is prevented. To prevent the third layer 43 from shearing or deforming, it is preferable that the third layer has a thickness of not less than 0.05 μm. On the other hand, by setting the thickness of the third layer 43 to not more than 0.5 μm, the thermal conductance of the entire protective film 4 is prevented from becoming too small. With these arrangements, the effect of preventing sticking is ensured without deteriorating the effect of promoting heat transfer from the heating resistor 3. Moreover, by setting the thickness of the third layer 43, which is relatively hard, to not more than 0.5 μm, the substrate 1 is prevented from excessively warping in forming the third layer 43 in the process of manufacturing the thermal printhead A.

TaN, which is the material of the third layer 43, has a contact angle with water of about 60 degrees and has a relatively high water repellency. Thus, even when the resin coating of the thermal paper sheet melts, the third layer 43 repels the melted resin coating. Thus, the resin coating is prevented from adhering to the third layer 43, which is suitable for preventing sticking.

The thermal printhead according to the present invention is not limited to the foregoing embodiment. The material of the third layer is not limited to TaN, and TiN—SiAlON may be employed instead. TiN—SiAlON is harder than the material of the second layer such as SiC and has a contact angle with water of about 58 degrees to have a relatively high water repellency. Thus, the employment of this material also achieves both of an increase in the printing speed and the prevention of sticking.

The invention claimed is:

1. A thermal printhead comprising:

a substrate;

a heating resistor supported by the substrate; and a protective film covering the heating resistor;

wherein the protective film includes a first layer held in contact with the heating resistor, a second layer covering the first layer and a third layer covering the second layer, the second layer being harder than the first layer and having a higher thermal conductivity than a thermal conductivity of the first layer, the third layer being harder than the second layer and thinner than the second layer; and wherein the third layer is made of one of TaN and TiN—SiAlON.

2. The thermal printhead according to claim 1, wherein the third layer has a thickness of 0.05 to 0.5 μm.

3. The thermal printhead according to claim 1, wherein the first layer is made of amorphous glass.

4. The thermal printhead according to claim 3, wherein the amorphous glass comprises SiO2—ZnO—MgO containing glass.

5. The thermal printhead according to claim 1, wherein the second layer is made of SiC.

* * * * *